US010961815B2

(12) United States Patent
Garcia et al.

(10) Patent No.: US 10,961,815 B2
(45) Date of Patent: Mar. 30, 2021

(54) APPARATUS AND METHOD FOR WET SHOE APPLICATIONS

(71) Applicant: Weatherford Technology Holdings, LLC, Houston, TX (US)

(72) Inventors: Cesar G. Garcia, Katy, TX (US); James A. Rochen, Waller, TX (US); Tharinda Wickramasinghe, Houston, TX (US); Douglas B. Farley, Missouri City, TX (US); Jamie Inglesfield, Houston, TX (US); Jobby T. Jacob, Sugar Land, TX (US); Daniel A. De Clute-Melancon, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/539,305

(22) Filed: Aug. 13, 2019

(65) Prior Publication Data

US 2021/0047898 A1 Feb. 18, 2021

(51) Int. Cl.

| | |
|---|---|
| ***E21B 33/16*** | (2006.01) |
| ***E21B 33/12*** | (2006.01) |
| ***E21B 34/14*** | (2006.01) |
| ***E21B 34/06*** | (2006.01) |

(52) U.S. Cl.

CPC ..... *E21B 33/16* (2013.01); *E21B 33/12* (2013.01); *E21B 34/063* (2013.01); *E21B 34/14* (2013.01); *E21B 2200/04* (2020.05); *E21B 2200/06* (2020.05)

(58) Field of Classification Search

CPC ..... E21B 34/14; E21B 33/16

See application file for complete search history.

(56) References Cited

U.S. PATENT DOCUMENTS

| | | | | |
|---|---|---|---|---|
| 4,407,369 | A * | 10/1983 | Hutchison | E21B 33/12 166/185 |
| 4,979,562 | A | 12/1990 | Langer | |
| 6,082,451 | A | 7/2000 | Giroux et al. | |
| 6,679,336 | B2 | 1/2004 | Musselwhite et al. | |
| 6,966,368 | B2 | 11/2005 | Farquhar | |

(Continued)

FOREIGN PATENT DOCUMENTS

EP 0753646 A2 1/1997

OTHER PUBLICATIONS

"Casing Wiper Plugs and Darts," Weatherford, 2013, 58 pages.

*Primary Examiner* — David J Bagnell
*Assistant Examiner* — Dany E Akakpo
(74) *Attorney, Agent, or Firm* — Blank Rome LLP

(57) ABSTRACT

An apparatus and method are disclosed for wet shoe applications in cementing tubing in a wellbore. A wet shoe tool has a seat and an insert in a flow bore of the tool. A first wiper plug is deployed down the tubing at least behind the cement and seats on the insert, which can then be moved in the flow bore to a bypass position allowing for fluid flow through the tool to produce a wet shoe track. A second plug is deployed down the tubing behind the second plug and seats on the seat in the flow bore of the tool. The seated second plug isolates applied pressure from passing downhole end of the tool so the integrity of the tubing can be tested. The second plug is self-removable (e.g., dissolvable) in the tool to reestablish fluid communication through the flow bore of the tool.

20 Claims, 4 Drawing Sheets

(56) References Cited

U.S. PATENT DOCUMENTS

| | | | | |
|---|---|---|---|---|
| 8,127,868 | B2 | 3/2012 | Giroux et al. | |
| 9,016,388 | B2 | 4/2015 | Kellner et al. | |
| 9,279,295 | B2 | 3/2016 | Williamson et al. | |
| 9,297,229 | B2 | 3/2016 | Rytlewski | |
| 9,441,440 | B2 | 9/2016 | Hofman et al. | |
| 9,476,282 | B2 | 10/2016 | Anton et al. | |
| 9,719,322 | B2 | 8/2017 | Geogel | |
| 9,920,591 | B2 | 3/2018 | Themig | |
| 10,260,306 | B1 | 4/2019 | Beckett et al. | |
| 2014/0116721 | A1 | 5/2014 | Hofman et al. | |
| 2014/0224479 | A1* | 8/2014 | Andrigo | E21B 33/16 166/192 |
| 2015/0285026 | A1* | 10/2015 | Frazier | E21B 33/1291 166/120 |
| 2015/0308208 | A1 | 10/2015 | Capps et al. | |
| 2016/0145995 | A1* | 5/2016 | Hannegan | E21B 47/0005 166/250.14 |
| 2018/0051533 | A1 | 2/2018 | Zbranek et al. | |
| 2018/0142528 | A1 | 5/2018 | George et al. | |

* cited by examiner

APPARATUS AND METHOD FOR WET SHOE APPLICATIONS

BACKGROUND OF THE DISCLOSURE

Operators may use a "wet shoe" at the end of casing, liner or other tubing where cement does not set around or obstruct a float valve (e.g. a check valve) at the end of the tubing. After cementing, fluid flow remains established through the tubing and float valve into the well. In this way, the wet shoe enables operators to conduct subsequent operations after cementing, such as pumping down plugs or perforating guns to the toe of the well.

When completing the wet shoe application, however, performing a full pressure check on the tubing is not feasible after the wiper plug has landed. For this reason, a full pressure check may not be performed in some implementations.

As will be appreciated, however, being able to the check the integrity of the tubing with a pressure check is preferred. During use, the tubing, such as casing, is subject to pressure changes and cycles during it operational like, and the structural integrity of the casing must be maintained.

The subject matter of the present disclosure is directed to overcoming, or at least reducing the effects of, one or more of the problems set forth above.

SUMMARY OF THE DISCLOSURE

According to the present disclosure, an apparatus is directed to cementing tubing in a wellbore with cement and testing the tubing with applied pressure. The apparatus comprises a tool, an insert, a first seat, a second seat, a first plug, and a second plug.

The tool is disposed on the tubing and has an uphole end and a downhole end. The tool defines a flow bore therethrough from the uphole end to the downhole end. The insert is disposed in the flow bore and has a first seat, and the insert is held in a first position by a releasable connection to the tool. The second seat is disposed in the flow bore uphole of the insert.

The first plug is deployable down the tubing at least behind the cement and is seatable on the first seat. The first plug seated in the insert is configured to prevent fluid communication through the flow bore from the uphole end to the downhole end. The insert with the seated first plug is movable from the first position to a second position in response to a first application of the applied pressure releasing the releasable connection. The insert in the second position is configured to permit fluid communication through the flow bore.

The second plug is deployable down the tubing behind the second plug and is seatable on the second seat in the flow bore of the tool. The seated second plug is configured to isolate a second application of the applied pressure from passing to the downhole end of the tool. The second plug is self-removable in the tool to reestablish fluid communication through the flow bore of the tool.

The first plug can comprise a bottom member and a top member. The bottom member can have a passage therethrough, and the passage can have a closure closing the passage. The bottom member is deployable down the tubing ahead of the cement and is seatable on the first seat. The closure of the bottom member is opened in response to an initial application of the applied pressure against the seated bottom member before the first application. The top member is deployable down the tubing behind the cement and is configured to close fluid communication through the passage in the bottom member.

The first plug can comprise a wiper dart having a head that is configured to seat in the first seat of the insert.

The insert can comprise a sleeve disposed in the flow bore. The sleeve can have a fluid passage therethrough with the first seat formed therein. The sleeve can define a bypass port communicating the fluid passage downhole of the first seat outside the sleeve.

The flow bore of the tool can define a relief therein. The insert in the second position can be spaced from the relief and can be configured to permit fluid communication in a space between the insert and the relief. The relief of the tool can define a shoulder toward the downhole end of the tool such that the shoulder can engage the insert in the second position. The shoulder can define a first castellation configured to engage a second castellation of the insert.

The second plug can comprise a self-removable material selected from the group consisting of a dissolvable material, an erodible material, a disintegrable material, a degradable material, an aluminum, a reactive metal, a magnesium alloy, a degradable composite polymer, a polystyrene, an elastomer, a resin, an adhesive, a polyester, a polymide, a thermoplastic polymer, a polyglycolide, a polyglycolic acid, and a thermosetting polymer.

The temporary connection can comprise one or more shear pins disposed between the insert and the flow bore of the tool.

According to the present disclosure, a method comprises: cementing tubing in a wellbore with cement by: pumping the cement through a flow bore of a tool disposed on the tubing, and seating a first plug at least behind the cement on a first seat in a first position in the flow bore of the tool; creating a wet shoe track by: moving the first seat from the first position to a second position in the flow bore with a first application of applied pressure against the seated first plug, and bypassing fluid communication through the flow bore of the tool around the seated first plug in the moved first seat; and testing the cemented tubing by: seating a second plug in a second seat in the flow bore of the tool uphole of the first seat, subjecting the cemented tubing to a second application of applied pressure against the seated second plug, and reestablishing fluid communication through the flow bore of the tool by self-removing the second plug from the second seat.

Cementing the tubing in the wellbore with the cement by seating the first plug at least behind the cement on the first seat can comprise seating a bottom member of the first plug ahead of the cement on the first seat, breaching a flow passage through the bottom member, passing the cement through the flow passage, and seating a top member of the first plug behind the cement in the flow passage of the bottom member.

Moving the first seat from the first position to the second position in the flow bore with the first application of applied pressure against the seated first plug can comprise releasing a temporary connection retaining the first seat in the first position inside the flow bore with the first application of applied pressure against the seated first plug.

Moving the first seat from the first position to the second position in the flow bore with the first application of applied pressure against the seated first plug can comprise shifting an insert having the first seat from the first position to a relief of the flow bore in the second position.

Bypassing the fluid communication through the flow bore of the tool around the seated first plug in the moved first seat can comprise bypassing the fluid communication from the relief of the flow bore through a side port defined in the insert downhole the first seat.

The foregoing summary is not intended to summarize each potential embodiment or every aspect of the present disclosure.

DETAILED DESCRIPTION OF THE DISCLOSURE

As disclosed herein, a wet shoe tool according to the present disclosure is used to produce bypass flow around wiper plug(s) to create a wet shoe track, where unset or no cement is left in a tubing section between a float collar and a shoe after a primary cement job. The wet shoe tool can be used for a number of applications, such as plug-and-perf applications, cementing liners and long strings, horizontal and vertical wells, etc.

The wet shoe tool provides a positive indication of cement displacement and wiper plug location. Adjustable shear values can be used in the wet shoe tool to provide a clear indication that wiper plug(s) have landed and that shearing events have occurred. For example, the tool can include an insert with a seat that matches the wiper plug. The insert can be configured to shear free with an adjustable and configurable shear value to meet the application at hand.

The wiper plug provides a positive indication upon landing at the tool, and applying pressure causes the shear insert to shift downward. At this point, excess displacement fluid bypasses the wiper plug and is pumped down through the shoe track and out of the toe to create a wet shoe.

After the wet shoe track is established, integrity of the tubing, casing, liner, or the like can be performed using a self-removing plug landed in a seat of the wet shoe tool. Once the testing is complete and the plug is removed, the re-established fluid circulation allows for other operations to be performed without requiring tubing-conveyed perforating to be performed in the casing to open of flow path. For example, wireline perforating guns and composite plugs can be pumped down to begin stimulation operations. If desired, the first stimulation operation can be performed through the wet shoe tool.

Figure 1A:
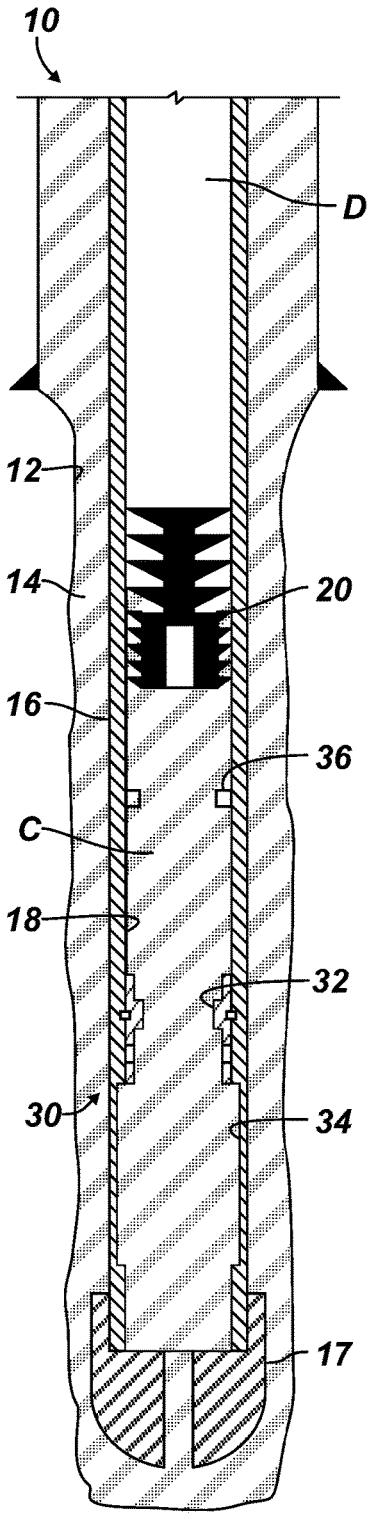
FIGS. 1A-1C illustrate an assembly during steps of a cementing procedure according to the present disclosure.
Figure 1B:
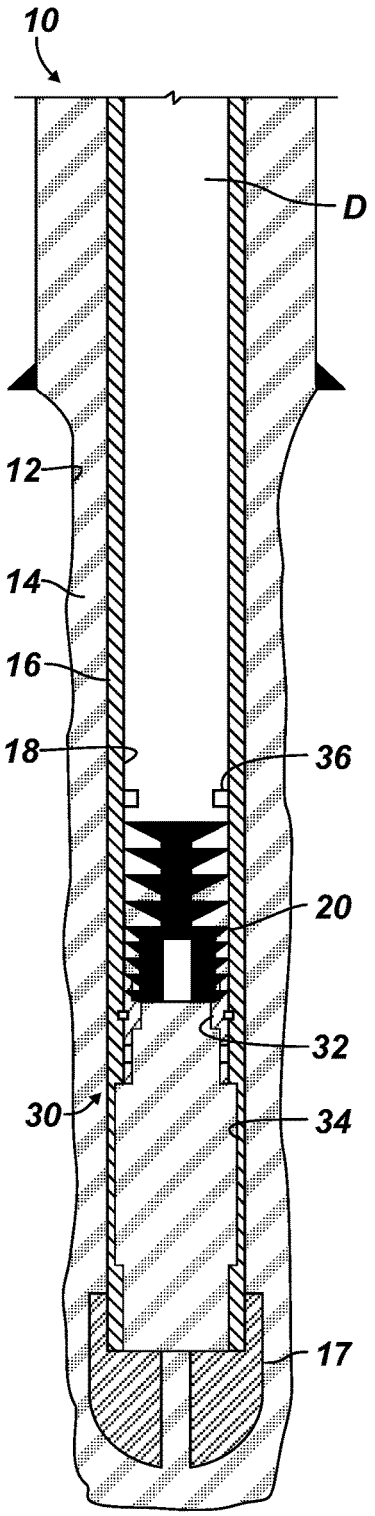
Figure 1C:
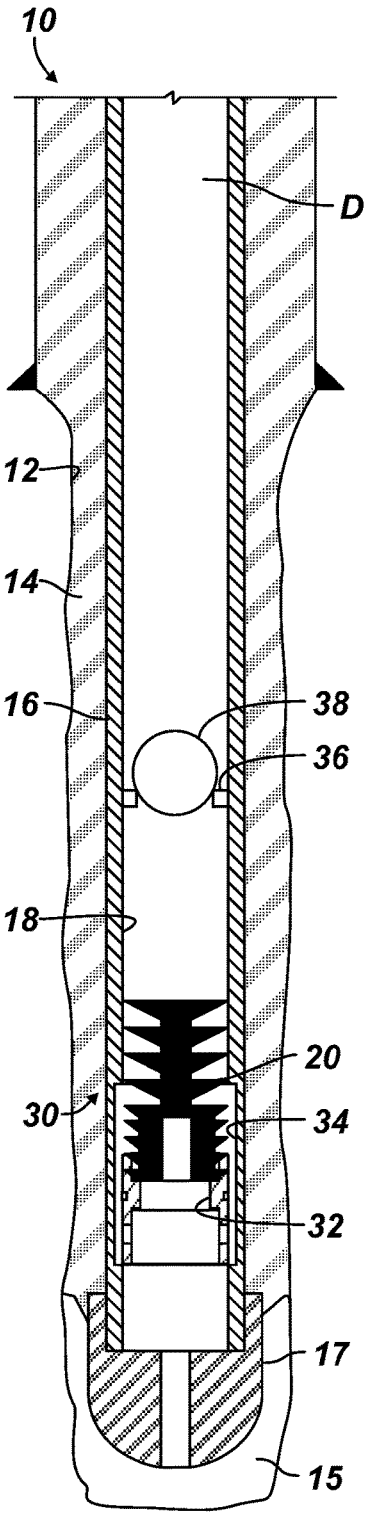

FIGS. 1A-1C illustrate an assembly 10 during steps of a cementing procedure according to the present disclosure. Tubing 16 is being cemented in a borehole 12. The tubing 16 referred to herein may be casing, production tubing, liner, tubulars, or the like. A wet shoe tool 30 is disposed on the tubing 16 and can be used with or part of a casing shoe/landing collar. For example, the wet shoe tool 30 can be disposed above a hydraulic landing collar, float shoe, or the like.

The wet shoe tool 30 is used for performing a wet shoe application, which is an operation that opens the flow path through the casing shoe after cementing. Once cement operations are complete, a wiper plug 20 lands in the wet shoe tool 30. Operators apply pressure to predetermined level to activate the tool 30 and open an internal bypass so fluid can pass through the tool 30. The opened fluid bypass allows operators to displace the cement and clear the float shoe, leaving a desired wet shoe track.

As shown in FIG. 1A, for example, an initial fluid slug followed by cement C has been pumped down through the bore 18 of the tubing 16, past a wet shoe tool 30, out the shoe 17, and into the annulus 14 of the borehole 12. The shoe 17 may be a one-way valve or a check valve, such as a float valve/collar, that permits fluid flow out of the tubing 16 and into the borehole 12, while preventing fluid flow into the assembly 10 from the borehole 12. The cement may be supplied through a work string (not shown) or the tubing 16 if the work string is removed.

A wiper plug 20 is pumped down the bore 18 of the tubing 16 behind the cement C using a displacement fluid D. The wiper plug 20 as disclosed herein may be any conventional cement/wiper plug used in well cementing operations known in the art.

Eventually, as shown in FIG. 1B, the wiper plug 20 reaches a landing sleeve or insert 32 in the wet shoe tool 30. Pressure applied behind the wiper plug 20 activates the wet shoe tool 30 by shifting the landing insert 32 into a bypass 34 of the tool 30, as shown in FIG. 1C. The displacement fluid D can now pass through the wet shoe tool 30 and out the assembly 10 via the bypass 34 to create a wet shoe track 15, which may have benefits in some implementations disclosed herein. For example, fluid communication is now established through the tubing 16 so additional operations can be performed without the need to perforate the tubing 16.

During use, the tubing 16 must withstand pressures for which the tubing 16 is designed. To test the integrity of the cemented tubing 16, the wet shoe tool 30 includes a landing seat 36 for receiving a plug 38 after the wiper plug 20 has landed in the tool 30, the insert 32 has shifted, and the bypass 34 has been opened. The plug 38 enables a full pressure test to be performed on the tubing 16 at a pressure level above the pressure used open the fluid flow through the wet shoe tool 30 after cementing.

To do the test, the plug 38, such as a ball, is pumped down the tubing 16 to the wet shoe tool 30 and lands in the seat 36 in the tool 30 so the plug seat 36 and the plug 38 can isolate the tubing 16 above the wet show tool 30. Pressure applied against the seated plug 38 can then be used to test the integrity of the cemented tubing 16 to desired test levels. A full pressure check can be completed by allowing operators to cycle and monitor pressure pumped in the tubing 16 behind the seated plug 36 to assess the integrity of the tubing 16.

The plug 38 is self-removing and will then dissolve away or otherwise be removed. Once the plug 38 is removed, fluid circulation is re-established through the wet shoe tool 30, allowing for the pump down of perforating guns, composite plugs, and the like for other operations to be performed. Being self-removing, the plug 38 is composed of a self-removable material that dissolves, disintegrates, or otherwise removes in time to re-establish flow through the tubing's bore 18 so subsequent operations can be performed. Reference herein to a self-removable material is meant to encompass any materials designed to dissolve, erode, disintegrate, or otherwise degrade over time and/or in certain wellbore conditions due to heat, temperature, hydrocarbon composition, introduced solvent, applied acid, or other factors. For example, the plug 38 can be composed of a dissolvable, degradable, disintegrable, or other self-removable material known in the art when subjected to appropriate conditions, such as a temperature for a period of time, an introduced acid or other fluid, the existing wellbore fluid, etc. For example, the material of the plug 38 can be aluminum, a reactive metal, a magnesium alloy, a degradable composite polymer, a polystyrene, an elastomer, a resin, an adhesive, a polyester, a polymide, a thermoplastic polymer, a polyglycolide, a polyglycolic acid, a thermosetting polymer, or the like, such as used for fracture balls.

Figure 2A:
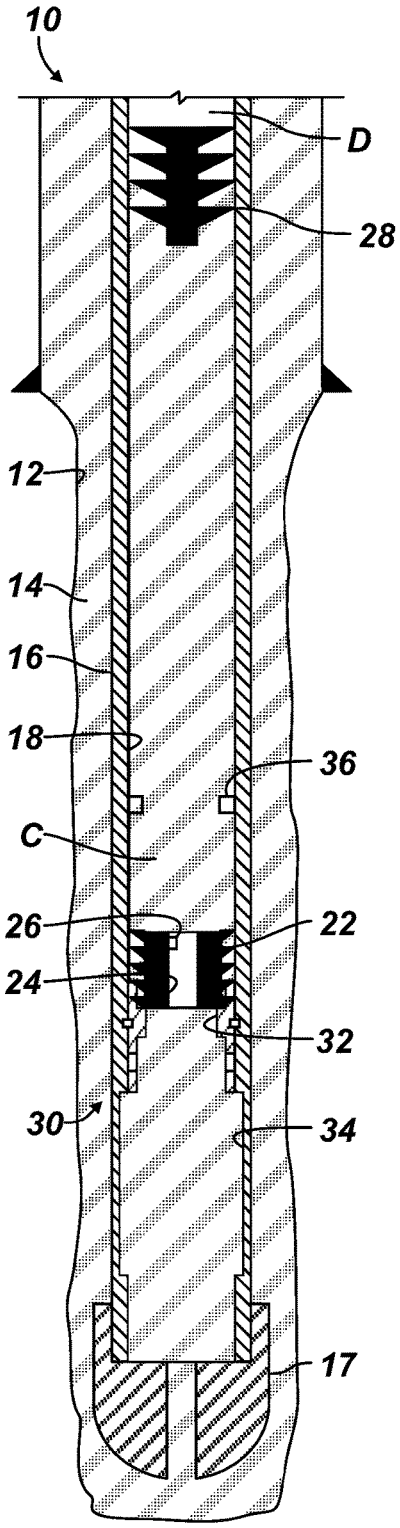
FIGS. 2A-2C illustrate another assembly during steps of a cementing procedure according to the present disclosure.
Figure 2B:
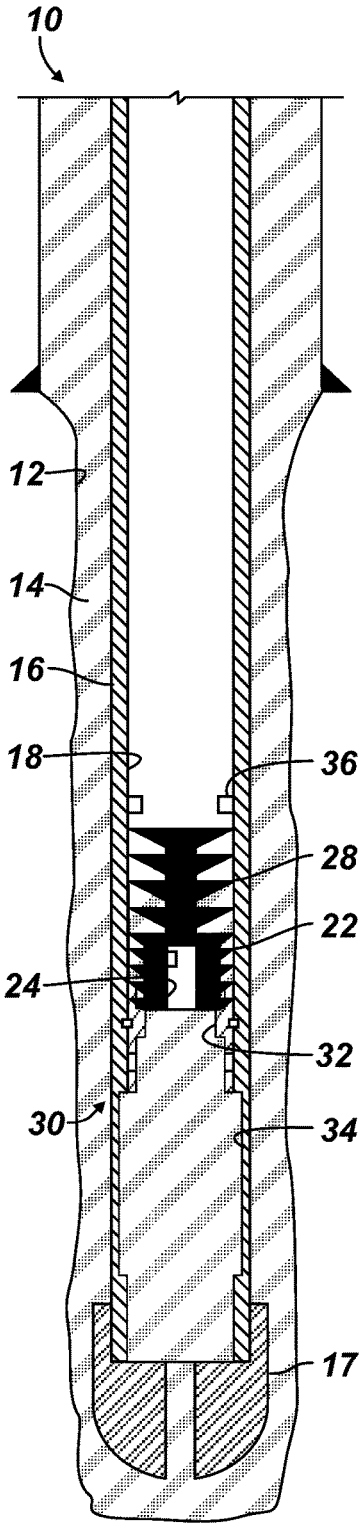
Figure 2C:
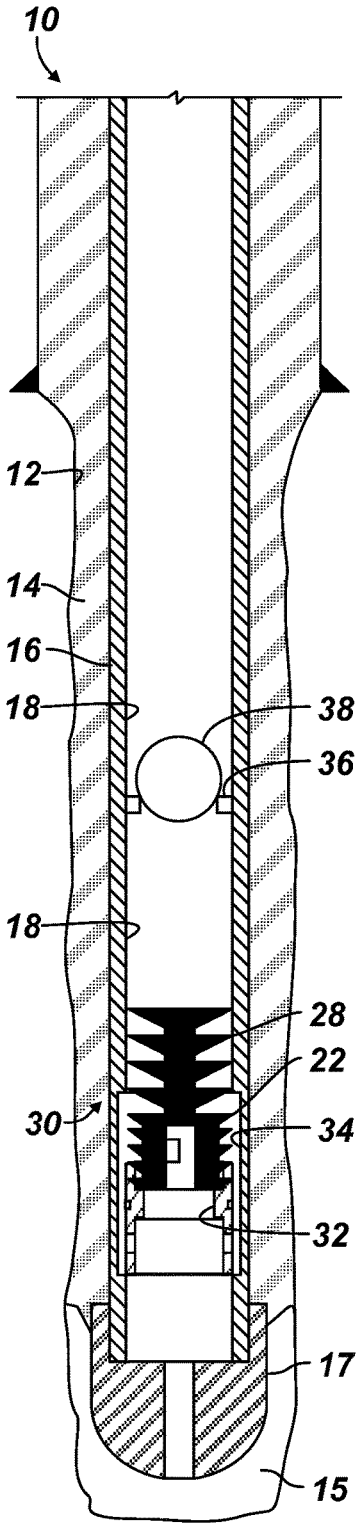

FIGS. 2A-2C illustrate another assembly 10 during steps of a cementing procedure according to the present disclosure. Again, tubing 16 is being cemented in a borehole 12. The cement C may be supplied through a work string (not shown) or through the tubing 16 if the work string is removed, and the cement C can be pumped behind a bottom wiper plug 22 and ahead of a top wiper plug 28. The wiper plugs 22, 28 as disclosed herein may be any conventional cement/wiper plugs used in well cementing operations known in the art.

As shown herein FIG. 2A, an initial fluid slug followed by a bottom wiper plug 22 and cement C has been pumped down through the bore 18 of the tubing 16. As shown in FIG. 2A, the bottom wiper plug 22 is pumped down the bore 18 of the tubing 16 ahead of the cement C. The bottom wiper plug 20 can be launched from a cementing head, displacing fluids through the tubing 16 while preventing cement contamination.

The bottom wiper plug 22 is pumped until it lands in the landing insert 32 of the wet shoe tool 30. A passage 24 through the bottom plug 22 has a closure 26 that has been opened by pressure, allowing the cement C pumped down through the bore 18 of the tubing 16 to pass through the bottom wiper plug 22, out the shoe 17, and into the annulus 14 of the borehole 12. The closure 26 can be a breachable element, such as a rupture disc, typically used on a bottom wiper plug.

Behind the cement, the top wiper plug 28 is pumped down the tubing bore 18 using a displacement fluid D, such as water. The top wiper plug 28 can be a stinger dart that is pumped behind cement and wipes the inside of the tubing 16, providing a mechanical barrier between the cement C and spacer fluids D. Eventually, as shown in FIG. 2A, the top wiper plug 28 reaches the bottom wiper plug 22 and closes the fluid passage 24 through the bottom plug 22. For example, a head of the top wiper plug 28 can fit into the plug's passage 24 and can latch therein.

After cementing the tubing 16 in the borehole 12, fluid flow through the end of the tubing 16 may be established to form a wet shoe track for conducting subsequent operations. In particular, pressure applied behind the wiper plugs 22, 28 activates the wet shoe tool 30 by shifting the landing insert 32 into the bypass 34 of the tool 30, as shown in FIG. 2C.

The displacement fluid D can now pass through the wet shoe tool 30 to create a wet shoe track 15, which may have benefits in the implementations disclosed herein. For example, fluid communication is now established through the tubing 16 so additional operations can be performed without the need to perforate the tubing 16.

To test the integrity of the cemented tubing 16, a plug 38, such as a ball, is pumped down the tubing 16 to the wet shoe tool 30 and lands in a seat 36 in the tool 30. Pressure applied against the seated plug 38 can then be used to test the integrity of the cemented tubing 16 to desired test levels. Again, the plug 38 is composed of a self-removable material that dissolves, disintegrates, or otherwise removes in time to re-establish flow through the tubing's bore 18 so subsequent operations can be performed.

Figure 3A:
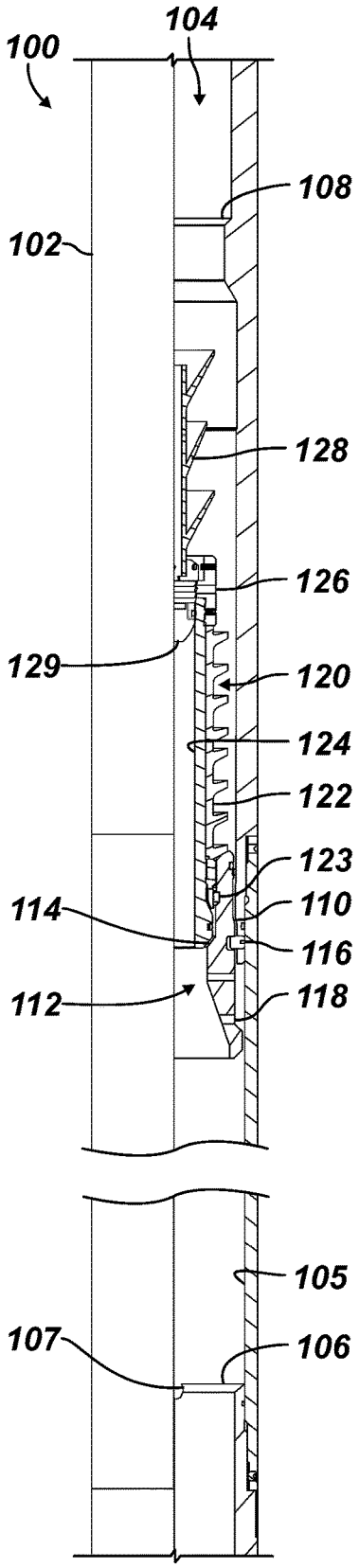
FIGS. 3A-3C illustrate a wet shoe assembly of the present disclosure during stages of operation.
Figure 3B:
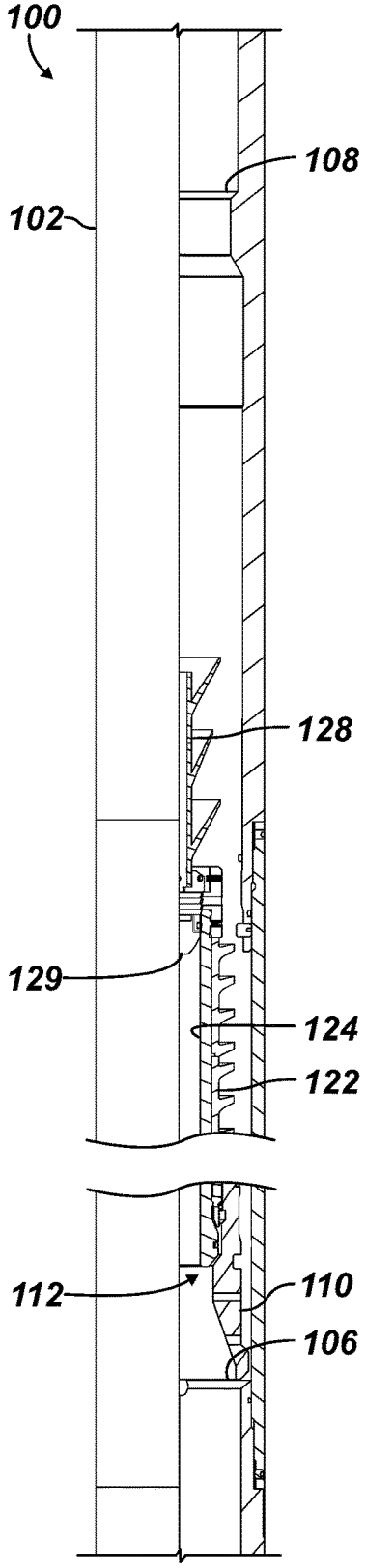
Figure 3C:
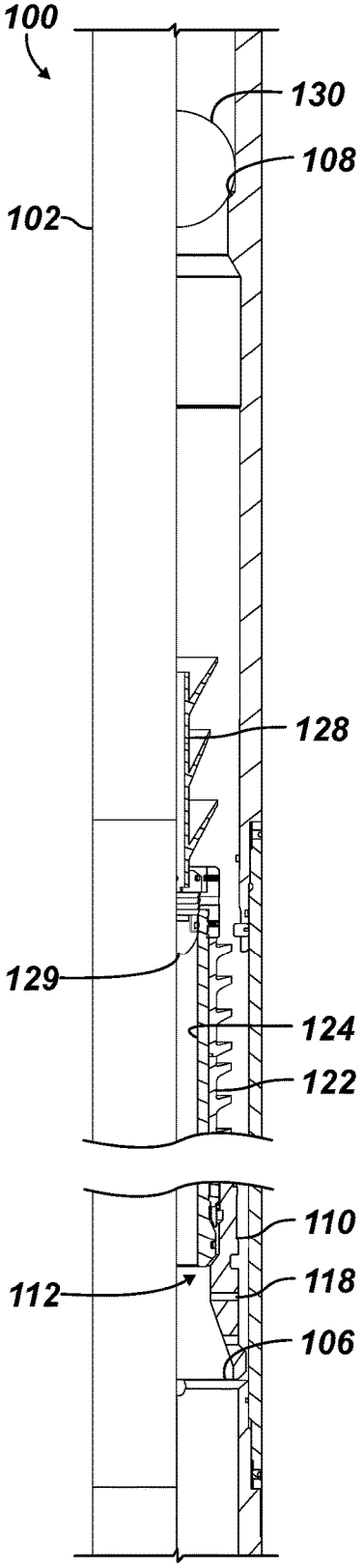

FIGS. 3A-3C illustrate a wet shoe assembly of the present disclosure during stages of operation. The assembly includes a wet shoe tool 100 and plugs 120, 130. A tool housing 102 has a bore 104 for flow therethrough. The bore 104 includes a bypass relief 105 and a landing shoulder 106 at a downhole end. Toward the uphole end, the housing 102 includes a plug seat 108. Intermediate the plug seat 108 and landing shoulder 106, a sleeve or insert 110 is arranged in the bore 104 and is held by shear pins 116 or other temporary retainer. The insert 110 includes a through-bore 112 with a landing shoulder 114. Side ports 118 in the side of the insert 110 communicate the through-bore 112 outside the insert 110.

As shown in FIG. 3A, a wiper plug 120 having wiper fins along the exterior lands in the landing shoulder 114 of the insert 110. As shown here, the wiper plug 120 can include a bottom wiper plug 122, which includes an internal passage 124 in which a top wiper plug 128 is seated. Depending on the implementation, the bottom and top wiper plugs 122, 128 can be pumped down together through the tubing 16 to the bore 104 of the housing 104 behind the pumped cement.

Alternatively, the bottom wiper plug 122 can be pumped ahead of the cement (not shown), a closure 126, such as a breachable element or a rupture disc, in the passage 124 of the bottom plug 122 can be breached to permit the cement to flow through the passage 124. For example, cement may be supplied at a pressure sufficient to breach/rupture the closure 126 in the bottom plug 122 (if necessary) and permit fluid flow through the flow passage 124 into the borehole 12. A predetermined amount of cement may be supplied into the borehole (12) to cement the tubing (16) therein. Eventually, the top plug 126 can be pumped behind the cement and can land in the passage 124 of the lower plug 120 to seal fluid flow.

With the plug arrangement as shown in FIG. 3A, pumped fluid against the plugs 122, 128 can break the releasable connections or shear pins 116, allowing the insert 110 to shift in the housing bore 104. For example, fluid may be supplied through the tubing (16) behind the plugs 122, 128 at a pressure sufficient to shear the pins 116 and shift the insert 110 to the bore relief 105. The pressure readings of the system before and after shearing the pins 116 may provide an indication at surface that the insert 110 and plugs 122, 128 are in the desired position.

As shown in FIG. 3B, the wet shoe tool 100 is shown once fluid flow is re-established to form a "wet shoe," which occurs when cement does not set around the float shoe (17) so that fluid may continue to be flowed through the float shoe (17) after the system is cemented in the borehole (12). Fluid is supplied against the seated plugs 122, 128 and the insert 110 at a pressure sufficient to release the releasable connection or shear pins 116. The insert 110 then moves in the flow bore 104 to a position where a lower shoulder of the insert 110 engages a landing shoulder 106 in the flow bore 104. Movement of the insert 110 also allows the plug 122, 128 to move out of sealed engagement with any polished bore inside the tool 100.

As shown in FIG. 3B, the insert 110 lands on the landing shoulder 106, and the fins of the plugs 122, 128 are spaced from the bypass relief 105. Castellations 107, 117 may prevent rotation. Fluid may now flow around the plugs 122, 128 and pass to the bypass relief 105. The side ports 118 in the insert 110 can communicate the flow from the bypass relief 105 to the downhole end of the bore 104. This fluid communication allows for a wet shoe track to be created so additional operations can be performed as disclosed herein. The reduction in pressure and/or the circulation of fluid flow into the borehole (12) can provide another indication at the surface of the position of the plugs 122, 128 and the insert 110, and that fluid communication through the system is open to conduct subsequent operations.

The cement is allowed to set so pressure testing can then be performed on the tubing (16). To test the integrity of the cemented tubing (not shown) on which the tool 100 is connected, the flowpath through the wet shoe tool 100 allows a self-removing plug 130, such as a ball, to be pumped down and seated on the plug seat 108 in the tool 100, as shown in FIG. 3C. Pressure applied against the seated plug 130 can then be used to test the integrity of the cemented tubing to desired test levels. As disclosed herein, the plug 130 is composed of a self-removing material that dissolves, disintegrates, or otherwise removes in time to re-establish flow through the tool's bore 104 so subsequent operations can be performed. Eventually, the plug 108 will be removed (e.g., dissolve over time) so that additional operations (plug and perf, ball drop frac, etc.) can be performed in the borehole (12) downhole of the open wet shoe tool 100.

With the wet shoe track established, fluid may be supplied through the wet shoe tool 100 into the borehole (12). In this way, a number of additional operations can be performed. For example, a perforating device may be pumped through the wet shoe tool 100 on a wireline to perforate one or more sections of the borehole (12). In another example, a plugging device may be pumped through the wet shoe tool 100 on a wireline to seal one or more downhole sections of the borehole (12). In yet another example, a perforating, fracturing, and/or another liner hanging operation may be conducted. The insert 110 can be composed of aluminum or composite material for ease in milling out when the plugs 122, 128 are milled out.

Figure 4A:
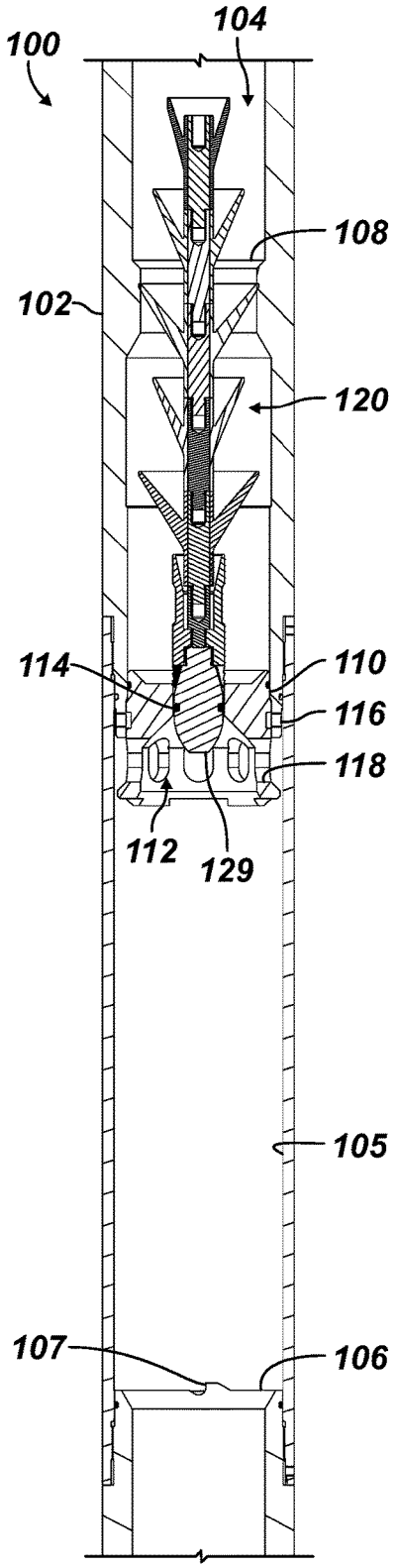
FIGS. 4A-4C illustrate another wet shoe assembly of the present disclosure during stages of operation.
Figure 4B:
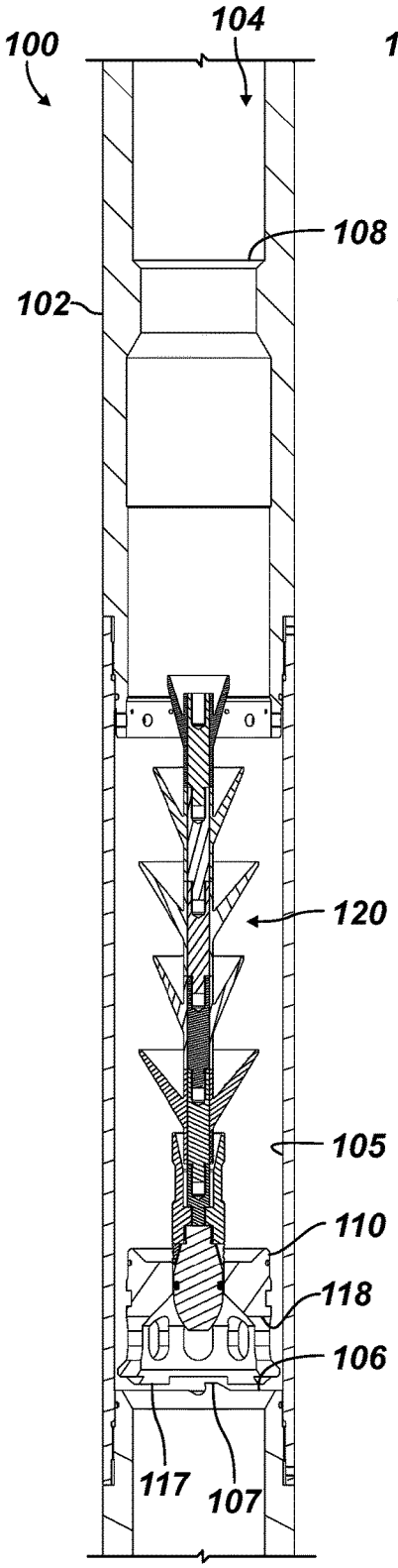
Figure 4C:
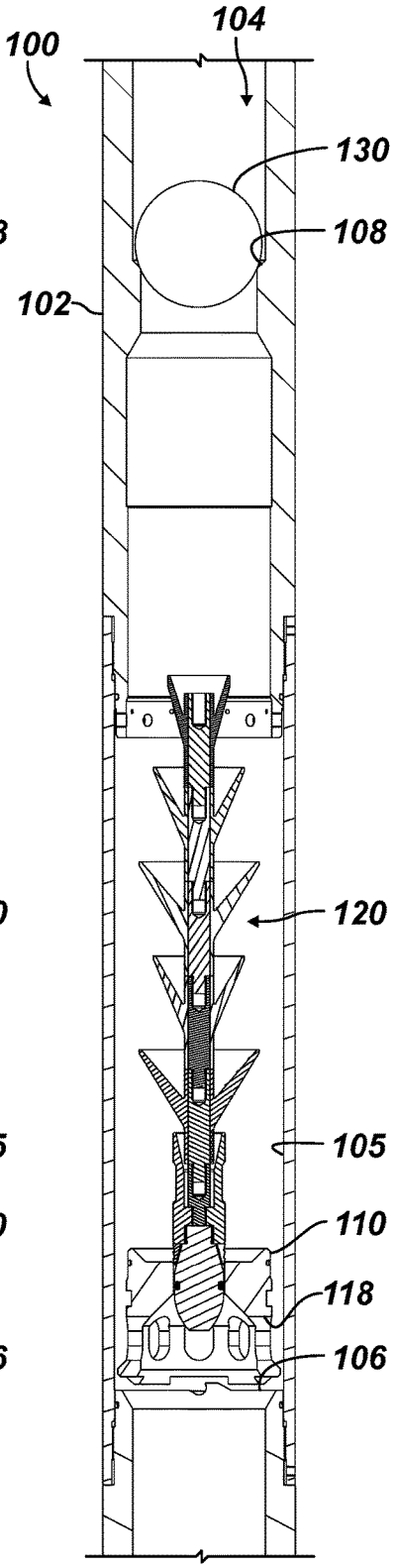

FIGS. 4A-4C illustrate another wet shoe assembly of the present disclosure during stages of operation. Again, the assembly includes a wet shoe tool 100 and plugs 120, 130. As before, a tool housing 102 has a bore 104 for flow therethrough. The bore 104 includes a bypass relief 105 and a landing shoulder 106 at a downhole end. Toward the uphole end, the housing 102 includes a plug seat 108. Intermediate the plug seat 108 and the landing shoulder 106, a sleeve or insert 110 is arranged in the bore 104 and is held by shear pins 116 or other releasable connection or retainer. The insert 110 includes a through-bore 112 with a landing shoulder 114. Side ports 118 in the side of the insert 110 communicate the through-bore 112 outside the insert 110.

As shown in FIG. 4A, a wiper plug 120 having wiper fins lands in the landing shoulder 114 of the insert 110. As shown here, the wiper plug 120 includes a head or nose 129 that seats in the landing shoulder 114. Depending on the implementation, the wiper plug 120 can be pumped behind the cement and can land in the seat 114 of the insert 110. For example, the wiper plug 120 in FIGS. 4A-4C can be stinger dart, featuring a seal ring on the nose 129, which enabling the seated plug 120 to withstand high differential pressures when latched into the seat 114 by a corresponding snap ring.

With the plug 120 seated as shown in FIG. 4A, pumped fluid against the plug 120 can break the releasable connection or shear pins 116, allowing the insert 110 to shift in the housing bore 104. As shown in FIG. 4B, the insert 110 lands on the landing shoulder 106, and the fins 122 of the plug 120 are spaced from the bypass relief 105. Flow through the housing bore 104 can pass around the plug 120 and to the bypass relief 105. The side ports 118 in the insert 110 can communicate the flow from the bypass relief 105 to the downhole end of the bore 104. This fluid communication allows for a wet shoe track to be created so additional operations can be performed as disclosed herein.

As before, castellations 107, 117 may prevent rotation. Likewise, the pressure increase and reductions and/or the circulation of fluid flow into the borehole (12) can provide indications to operators at the surface of the position of the plug 120 and the insert 110, and that fluid communication through the system is open to conduct subsequent operations.

To test the integrity of the cemented tubing (not shown) on which the tool 100 is deployed, a plug 130, such as a ball, is pumped down to the wet shoe tool 100 and lands in the plug seat 108 in the tool 100. Pressure applied against the seated plug 130 can then be used to test the integrity of the cemented tubing to desired test levels. The plug 130 is composed of a material that dissolves, disintegrates, or otherwise removes in time, re-establish flow through the tool's bore 104 so subsequent operations can be performed.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for cementing tubing in a wellbore with cement and testing the tubing with applied pressure, the apparatus comprising:

a tool disposed on the tubing and having an uphole end and a downhole end, the tool defining a flow bore therethrough from the uphole end to the downhole end, wherein the flow bore of the tool defines a relief therein;

an insert disposed in the flow bore and having a first seat, the insert being held in a first position by a releasable connection to the tool;

a second seat disposed in the flow bore uphole of the insert;

a first plug deployable down the tubing at least behind the cement and being seatable on the first seat, the first plug seated in the insert configured to prevent fluid communication through the flow bore from the uphole end to the downhole end, the insert with the seated first plug being movable from the first position to a second position in response to a first application of the applied pressure releasing the releasable connection, the insert in the second position spaced from the relief and configured to permit fluid communication through the flow bore in a space between the insert and the relief; and a second plug being deployable down the tubing behind the first plug and being seatable on the second seat in the flow bore of the tool, the seated second plug configured to isolate a second application of the applied pressure from passing to the downhole end of the tool, the second plug being self-removable in the tool to reestablish fluid communication through the flow bore of the tool.

2. The apparatus of claim 1, wherein the first plug comprises:

a bottom member having a passage therethrough, the passage having a closure closing the passage, the bottom member being deployable down the tubing ahead of the cement and being seatable on the first seat, the closure of the bottom member being opened in response to an initial application of the applied pressure against the seated bottom member before the first application; and a top member being deployable down the tubing behind the cement and being configured to close fluid communication through the passage in the bottom member.

3. The apparatus of claim 1, wherein the first plug comprises a wiper dart having a head, the head configured to seat in the first seat of the insert.

4. The apparatus of claim 1, wherein the insert comprises a sleeve disposed in the flow bore, the sleeve having a fluid passage therethrough with the first seat formed therein, the sleeve defining a bypass port downhole of the first seat, the bypass port communicating the fluid passage with the relief outside the sleeve.

5. The apparatus of claim 1, wherein the relief of the tool defines a shoulder toward the downhole end of the tool, the shoulder engaging the insert in the second position.

6. The apparatus of claim 5, wherein the shoulder defines a first castellation configured to engage a second castellation of the insert.

7. The apparatus of claim 1, wherein the second plug comprises a self-removable material selected from the group consisting of a dissolvable material, an erodible material, a disintegrable material, a degradable material, an aluminum, a reactive metal, a magnesium alloy, a degradable composite polymer, a polystyrene, an elastomer, a resin, an adhesive, a polyester, a polymide, a thermoplastic polymer, a polyglycolide, a polyglycolic acid, and a thermosetting polymer.

8. The apparatus of claim 1, wherein the releasable connection comprises one or more shear pins disposed between the insert and the flow bore of the tool.

9. The apparatus of claim 1, wherein the second plug comprises a ball.

10. A method, comprising:

cementing tubing in a wellbore with cement by: pumping the cement through a flow bore of a tool disposed on the tubing, and seating a first plug at least behind the cement on a first seat of an insert in a first position in the flow bore of the tool, wherein the flow bore of the tool defines a relief therein;

creating a wet shoe track by: moving the insert having the first seat from the first position to a second position in the flow bore with a first application of applied pressure against the seated first plug, the insert in the second position spaced from the relief, and bypassing fluid communication through the flow bore of the tool around the seated first plug in the moved first seat in a space between the insert and the relief; and testing the cemented tubing by: seating a second plug in a second seat in the flow bore of the tool uphole of the first seat, subjecting the cemented tubing to a second application of applied pressure against the seated second plug, and reestablishing fluid communication through the flow bore of the tool by self-removing the second plug from the second seat.

11. The method of claim 10, wherein cementing the tubing in the wellbore with the cement by seating the first plug at least behind the cement on the first seat comprises seating a bottom member of the first plug ahead of the cement on the first seat, breaching a flow passage through the bottom member, passing the cement through the flow passage, and seating a top member of the first plug behind the cement in the flow passage of the bottom member.

12. The method of claim 10, wherein moving the insert having the first seat from the first position to the second position in the flow bore with the first application of applied pressure against the seated first plug comprise releasing a temporary connection retaining the insert having the first seat in the first position inside the flow bore with the first application of applied pressure against the seated first plug.

13. The method of claim 12, wherein the temporary connection comprises one or more shear pins disposed between the insert and the flow bore of the tool.

14. The method of claim 10, wherein moving the insert having the first seat from the first position to the second position in the flow bore with the first application of applied pressure against the seated first plug comprises shifting the insert having the first seat from the first position to the relief of the flow bore in the second position.

15. The method of claim 14, wherein bypassing the fluid communication through the flow bore of the tool around the seated first plug in the moved first seat comprises bypassing the fluid communication from the relief of the flow bore through a side port defined in the insert downhole the first seat.

16. The method of claim 10, wherein moving the insert having the first seat from the first position to the second position in the flow bore comprises engaging the insert on a shoulder defined in the flow bore toward the downhole end of the tool.

17. The method of claim 10, wherein engaging the insert on the shoulder comprises engaging a first castellation on the insert with a second castellation of the shoulder.

18. The method of claim 10, wherein the second plug comprises a self-removable material selected from the group consisting of a dissolvable material, an erodible material, a disintegrable material, a degradable material, an aluminum, a reactive metal, a magnesium alloy, a degradable composite polymer, a polystyrene, an elastomer, a resin, an adhesive, a polyester, a polymide, a thermoplastic polymer, a polyglycolide, a polyglycolic acid, and a thermosetting polymer.

19. The method of claim 10, wherein seating the first plug at least behind the cement on the first seat of the insert comprises seating a head of a wiper dart configured to seat in the first seat of the insert.

20. The method of claim 10, wherein seating the second plug in the second seat comprises seating a ball for the second plug in the second seat.

* * * * *